United States Patent [19]

Svoboda et al.

[11] 4,444,411

[45] Apr. 24, 1984

[54] SAFETY SKI BINDING

[75] Inventors: Josef Svoboda, Schwechat; Gerhard Oberleitner, Vienna, both of Austria

[73] Assignee: TMC Corporation, Baar, Switzerland

[21] Appl. No.: 373,310

[22] Filed: Apr. 29, 1982

[30] Foreign Application Priority Data

May 4, 1981 [AT] Austria ..... 1964/81

[51] Int. Cl.[3] ..... A63C 9/00

[52] U.S. Cl. ..... 280/611; 280/612

[58] Field of Search ..... 280/611, 612; 307/117, 307/120, 116

[56] References Cited

U.S. PATENT DOCUMENTS 3,251,607 5/1966 Wren ..... 280/612

FOREIGN PATENT DOCUMENTS 2049994 4/1972 Fed. Rep. of Germany ..... 280/612
2705174 8/1977 Fed. Rep. of Germany ..... 280/612
2748309 5/1978 Fed. Rep. of Germany ..... 280/612

*Primary Examiner*—Joseph F. Peters, Jr.
*Assistant Examiner*—Joseph McCarthy
*Attorney, Agent, or Firm*—Flynn, Thiel, Boutell & Tanis

[57] ABSTRACT

A safety ski binding includes a first jaw which is fixedly mounted on a ski and a second jaw which is supported movably on the ski and includes an electrically activated release mechanism. A piezoelectric sensor is provided on each jaw, the sensor in the first jaw being wired to a signal-processing circuit provided in the ski and powered by a battery provided in the ski. An electromagnetic coupling is provided to couple the circuitry in the ski with and to provide power to the release mechanism and sensor in the second jaw. Signals from the sensor in the second jaw are transmitted to the signal-processing circuit through the electromagnetic coupling. The signal-processing circuit evaluates the signals received from both sensors and, when a release is required, sends a signal through the electromagnetic coupling to activate the release mechanism.

4 Claims, 7 Drawing Figures

SAFETY SKI BINDING

FIELD OF THE INVENTION

This invention relates to a safety ski binding and, more particularly, to a safety ski binding having two jaws and a signal-processing circuit which controls at least one release mechanism and is connected to same and to at least one sensor by respective transmitting paths.

BACKGROUND OF THE INVENTION

In such bindings, it has been common up to now to provide purely galvanic connections, typically wires, as transmitting paths between the signal-processing circuit and the sensors and release mechanism, wherein conductor paths are provided which are embedded in the ski and with which the sensors or the signal-processing circuit are connected.

A disadvantage of such arrangements is that, for example due to penetrating water, corrosion or oxidation of the conductor paths or of contact elements which engage the conductor paths can easily occur, which can lead to a degradation of the contact engagement until a complete interruption of current flow occurs, rendering the binding useless until considerable repairs are made. Furthermore, the resistance of the conductor paths can be changed considerably by such corrosion, causing such an influence on the release characteristic of the binding that its reliability is seriously affected.

One important goal of the invention is therefore to provide a binding of the abovementioned type which is distinguised by a high degree of reliability, even after long use, and in which stability of any resistance in connections between respective circuit components is assured.

SUMMARY OF THE INVENTION

According to the invention, at least one of the conductive or transmitting paths which lead to the signal-processing circuit has a transmitter-receiver arrangement, the receiver of which is galvanically separated from the transmitter.

In this manner, it is no longer necessary to provide previously used contact pins or contact screws which connected elements of the electric circuit of the binding arranged in the jaw such as sensors, a release mechanism, and a signal-processing circuit to the conductive paths provided on the ski which often served as the source of improper operation. Furthermore, the transmitter-receiver arrangement facilitates transmission of signals in a manner which is substantially uninfluenced by corrosion or oxidation of the conductor paths. Moreover, the possibility exists to protect the lines which lead to the transmitter and away from the receiver, as well as other electronic structural parts, with a sealing compound. The latter was not possible in conventional solutions, at least in the area of the connection between a contact pin or contact screw and a conductive path arranged on the ski.

In a preferred embodiment of the invention, it is provided that one element of a transmitter-receiver arrangement is arranged in a jaw and the associated element in the ski, in which ski are also preferably arranged the signal-processing circuit and the battery provided for supplying power. This makes it possible to arrange the transmitter and receiver near one another, so that the energy which is needed for transmission, as well as transmission losses, remain low.

According to a further characteristic of the invention, it is provided that the electronic signal-processing circuit is connected to the mentioned transmitter and to at least one receiver which belongs to a further transmitter-receiver arrangement, the transmitter of the further arrangement being provided with the energy needed for transmitting a release command and also with the energy needed for its operation as well as operation of the release mechanism through the first mentioned transmitter-receiver arrangement. In this manner, it is possible to reliably and safely transmit signals to and from a signal-processing circuit provided in the ski without interference from uncontrollable influences such as the changing contact resistance which can occur in conventional systems.

If particular importance is placed on a space-saving and particularly thin design of the transmitter-receiver arrangements, then it is advantageous if the transmitter-receiver arrangements inventively include capacitively coupled and electrically isolated or insulated conductive plates, one plate being embedded in the ski and the other in a jaw, preferably a jaw which is provided with a thrust-balancing mechanism.

If, however, as a result of the design of the binding, the transmission of large amounts of energy is desired, for example in order that a single battery provided for example in the ski will be sufficient for effecting operation of the entire electric circuit of the binding, and in order to be able to avoid any need for very large capacitors for energy storage in the jaw provided with the release mechanism, it is advantageous if the transmitter-receiver arrangements inventively include coupled coils which are preferably provided with iron cores.

BRIEF DESCRIPTION OF THE DRAWINGS

The invention will now be discussed in greater detail in connection with the drawing, in which.

DETAILED DESCRIPTION

Figure 1:
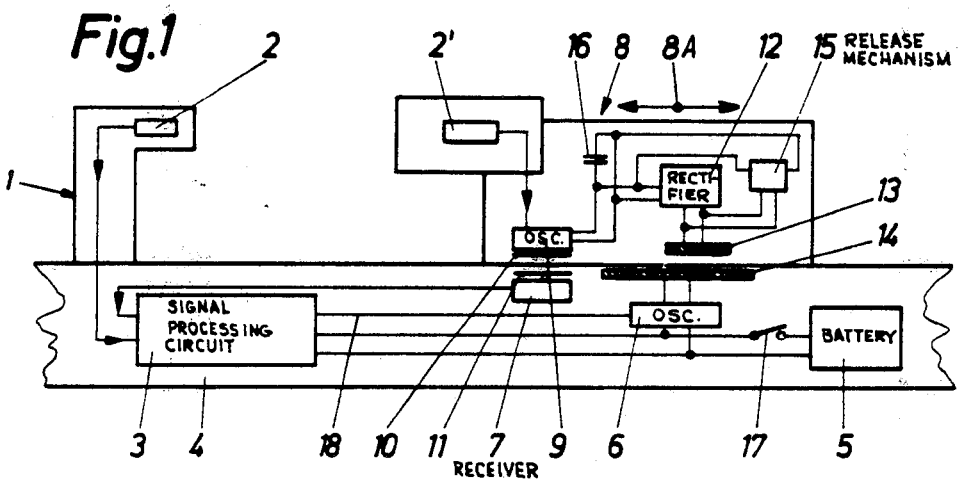
FIG. 1 is a schematic diagram illustrating an inventive binding.

FIG. 1 identifies with reference numeral 1 a stationary jaw of a ski binding, on which is arranged a sensor 2, preferably piezoelectric, which delivers which correspond with forces acting thereon to an electronic signal-processing circuit 3 arranged in the ski 4.

The electronic signal-processing circuit 3 is connected to a battery 5 which serves as a current source therefor, is also stored in the ski 4, and also supplies power to an oscillator circuit 6 which is arranged in the ski 4. The electronic signal-processing circuit 3 is also connected to a receiver circuit 7.

A further sensor 2' is arranged in the heel holder or jaw 8, which is preferably supported for movement in the directions of the arrows 8A and is yieldably urged toward the jaw 1 by a conventional and not illustrated thrust-balancing mechanism. The sensor 2' is connected to an oscillator circuit 9 which in turn is connected to an electrically isolated or insulated conductive plate 10, these parts serving as a transmitter arrangement. The plate 10 is aligned with an electrically isolated or insulated conductive plate 11 which is arranged in the ski 4 and is connected to the receiver circuit 7, whereby signals can be transmitted from the circuit 9 to the circuit 7 through the capacitive coupling between the plates 10 and 11.

Energy is supplied to the oscillator circuit 9, which is modulated by the signal of the sensor 2', by a rectifier 12 which is connected to a coil 13 arranged in the jaw 8, which coil 13 is inductively coupled with a coil 14 arranged in the ski 4 and connected to the oscillator circuit 6.

In other words, the oscillator circuit 6 provides an a.c. signal to the coil 14. Through electromagnetic coupling of the coils 14 and 13, the a.c. signal is induced in coil 13 and applied to rectifier 12, and rectifier 12 produces a d.c. signal which powers the oscillator circuit 9.

An electrically activated release mechanism 15 for the heel holder 8 is arranged therein, which release mechanism can mechanically retain the heel holder 8 in a closed position until a release is to occur and is electrically connected to the output of the rectifier 12 and to the coil 13. In order to provide sufficient current for actuation of the release mechanism 15, the current requirements of which increase during a release, a capacitor 16 is provided across the output of the rectifier to store energy. The details of the release mechanism 15 are not part of the present invention. The release mechanism 15 is preferably similar to that disclosed in copending U.S. Ser. No. 315,671 filed Oct. 27, 1981 and entitled "SAFETY SKI BINDING".

When a ski shoe which is not illustrated is inserted into the binding, then a switch 17 is closed, so that the oscillator circuit 6 and the electronic signal-processing circuit 3 are supplied with current. The switch 17 can, for example, be a reed switch arranged in the ski and controlled by a not illustrated permanent magnet arranged on the jaw 8. Furthermore, use of an electronic switch would also be possible, which switch is, for example, controlled by a piezoelectric element arranged on the ski 4 in the area thereof which a ski shoe presses against when held in the binding.

The details of the electronic signal-processing circuit 3 are not part of the present invention. The circuit 3 is preferably similar to that disclosed in Austrian Patent No. 299 031, German Offenlegungschrift No. 25 19 544, U.S. Pat. No. 3,892,980, copending U.S. Ser. No. 315,671 filed Oct. 27, 1981 and entitled "Safety Ski Binding", or copending U.S. Ser. No. 345,109 filed Feb. 2, 1982 and entitled "Safety Ski Binding" the disclosures of which are incorporated herein by reference. The circuit 3 must be able to monitor signals which come from the sensors 2 and 2' for certain characteristics which indicate the occurrence of dangerous forces acting on the ski shoe and in such a case to provide a release signal through the line 18 which influences the oscillator circuit 6.

Figure 1A:
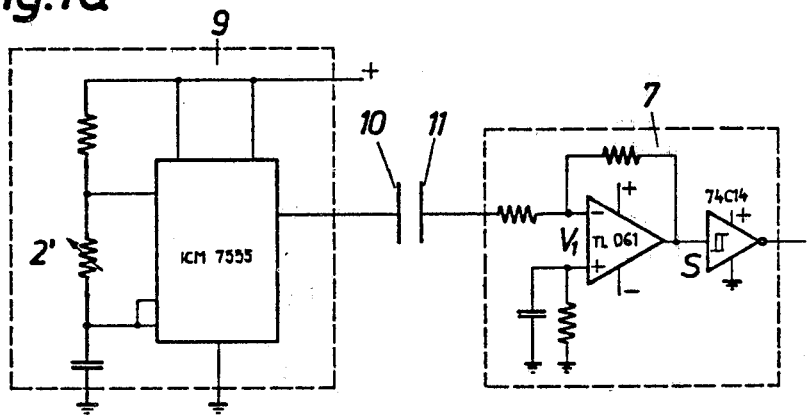
FIGS. 1*a* and 1*b* are schematic diagrams illustrating parts of the circuitry of the binding of FIG. 1.
Figure 1B:
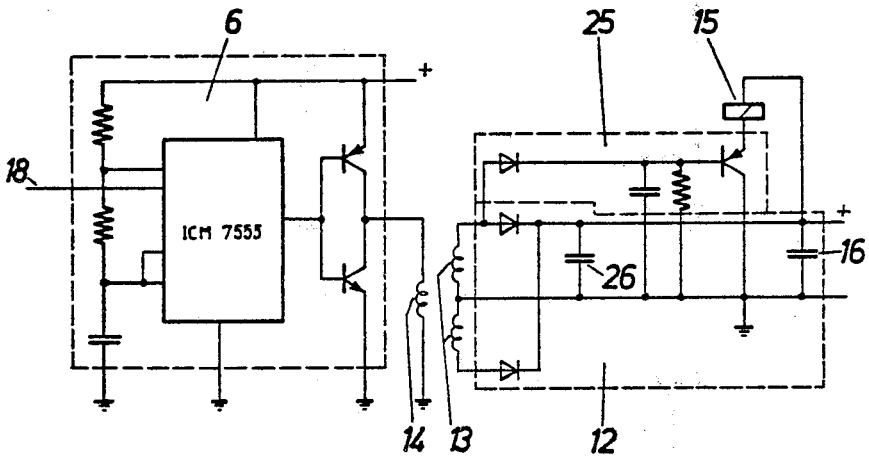

This release signal can, for example, effect an interruption of the output of the oscillator circuit 6, a change in its oscillating frequency or a change of the amplitude of its output waveform. This can be achieved in a simple manner by circuit elements which react to the release signal of the signal-processing circuit 3 and are built into the oscillator circuit 6, for example capacitors, inductors or resistive damping members. The circuit 6 is illustrated in FIG. 1*b* and is a conventional circuit. The rectifier 12 supplies power to the release mechanism 15 and the oscillator circuit 9. The capacitors 16 and 26 filter the direct voltage and cover the peak load in case the release mechanism 15 operates. The circuit 25 illustrated in FIG. 1*b* controls the release mechanism 15. In any case, the signal which is induced in the coil 13 arranged in the jaw 8 changes as a result, which causes the release mechanism 15 to be activated and, for example, to route current from the capacitor 16 through an electromagnet which releases the mechanical locking of the jaw 8 under control of one or more circuit elements which react to certain output signals from the coil 13.

The rectifier 12 supplies current, as already mentioned, to the oscillator circuit 9, which is responsive to signals received from the sensor 2' and is connected to the conductive plate 10. The oscillator circuit 9, which is illustrated in FIG. 1*a*, is a conventional circuit. The sensor 2' can, for example, be a resistive wire strain sensor, which makes it possible to modulate the oscillating signal supplied to the conducting surface 10 with a signal proportional to the forces which act onto the sensor 2'. This results in a change in the output signals from the conducting surface 11 which is capacitively coupled with the conducting surface 10, which output signals are amplified ($V_1$) and demodulated by a Schmitt-trigger S in the receiver circuit 7, illustrated in FIG. 1*a*, and fed to the electronic signal-processing circuit 3. The circuit 3 processes these signals together with the signals from the sensor 2, evaluating them for the presence of criteria indicating a release is necessary.

The connection between the sensor 2 arranged in the jaw 1 and the signal-processing circuit 3 is effected, in the illustrated embodiment, by a galvanic line such as a wire, but this connection can also be effected, as in the case of the sensor 2', with a transmitter-receiver arrangement utilizing electromagnetic coupling.

In the exemplary embodiment according to FIG. 1, the sensors 2 and 2' each produce a relatively continuous analog signal. The invention can be applied with the same advantage to a sensor which, upon exceeding a certain threshold value, radically changes its output signal. Some possible arrangements using such sensors are schematically illustrated in FIGS. 2 to 4.

Figure 2:
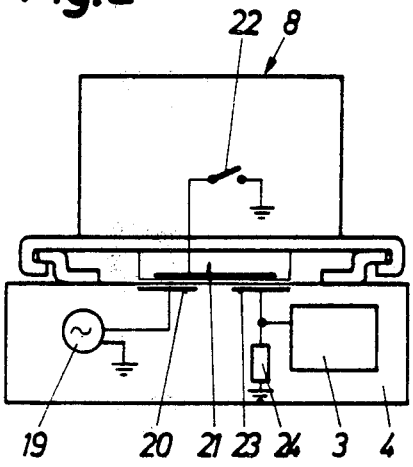
FIGS. 2 to 4 are respective schematic diagrams which illustrate various alternative embodiments for effecting transmission of signals which come from sensors constructed as switches.
Figure 3:
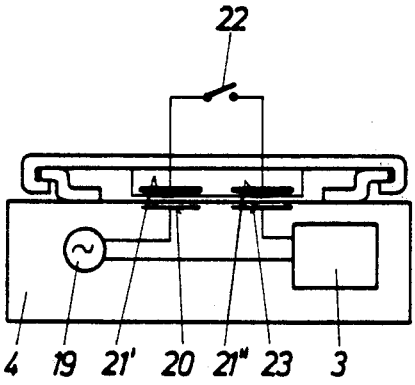
Figure 4:
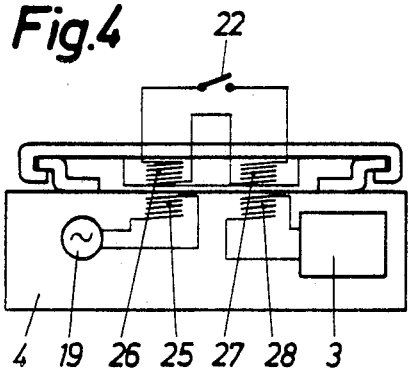

For convenience, the entire circuit is not illustrated in each of the FIGS. 2 to 4, but only that portion corresponding to the elements 2', 9, 10, 11, 7 and 3 in FIG. 1.

According to FIG. 2, an oscillator circuit 19 is connected to an electrically isolated or insulated conductive surface 20 which is coupled capacitively with a larger conductive plate 21 which is arranged electrically isolated or insulated in the jaw 8. The plate 21 is connected to one terminal of a sensor 22 which is constructed as a switch and monitors for example the correct conditions for keeping the jaw 8 closed, the sensor 22 having its second terminal grounded. The switch 22 is preferably a mechanical switch and is preferably similar to one of the switches disclosed in U.S. Pat. No. 4,311,321. The plate 21 is furthermore capacitively coupled with a second conducting plate 23 which is arranged electrically isolated or insulated in the ski 4, which plate 23 in turn is connected to the signal-processing circuit 3 and a resistor 24 which is connected to ground.

When the sensor 22 constructed as a switch is in its open position, signals which are produced by the oscillator circuit 19 are propagated due to the inductive coupling of the conductive plates 20, 21 and 23, to the signal-processing circuit 3, whereas in the closed position of the sensor 22, the plate 21 is grounded and no signals reach the conducting surface 23 and circuit 3.

FIG. 3 illustrates a floating embodiment which is slightly modified with respect to FIG. 2, in which embodiment two plates 21' and 21'' which are arranged electrically isolated or insulated in the jaw 8 and are respectively capacitively coupled with conductive surfaces 20 and 23 which are arranged electrically isolated or insulated in the ski 4 can be connected to one another by the sensor 22 which is constructed as a switch. When the sensor 22 is closed, signals are transmitted from the oscillator circuit 19 to the signal-processing circuit 3, but these signals are interrupted when the sensor 22 is open.

An arrangement which in principle is generally the same as in FIG. 3 is illustrated in FIG. 4, the only difference being that the signal transmission does not occur through capacitive coupling but through inductive coupling between coils 25 and 26 and coils 27 and 28, the coils 25 and 28 being arranged in the ski 4 and respectively connected to the oscillator circuit 19 and the signal-processing circuit 3, and the coils 26 and 27 being arranged in the jaw 8 and being connected to one another when the sensor 22 is closed.

Figure 5:
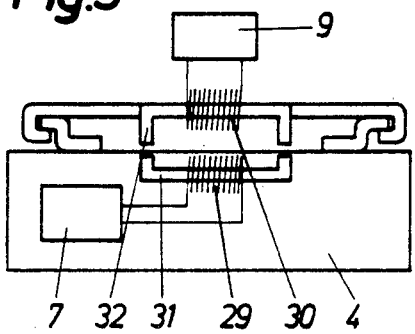
FIG. 5 is a schematic diagram which illustrates a preferred arrangement for effecting signal transmission.

FIG. 5 schematically illustrates a further embodiment for transmitting and receiving a signal with inductive coupling, which arrangement is particularly suited for the transmission of high energy signals. In this embodiment, the plates 10 and 11 of FIG. 1 have been replaced with coils 29 and 30 which have laminated ferric cores 31 and 32, respectively. The iron cores, for reasons of easy assembly are advantageously constructed as two parts which meet within the coil. The two coils 30 and 29 are respectively connected to the oscillator circuit 9 and receiver circuit 7.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a safety ski binding adapted to be mounted on a ski and having two jaws and a signal-processing circuit which controls at least one release mechanism and is connected with said release mechanism and with a sensor through respective transmitting paths, at least one of said transmitting paths having a first transmitter-receiver arrangement which includes a first transmitter and a first receiver which are separated galvanically from one another, the improvement comprising wherein the other of said transmitting paths has a second transmitter-receiver arrangement which includes a second transmitter and a second receiver, and wherein said signal-processing circuit is connected to said first transmitter and to said second receiver of said first and second transmitter-receiver arrangements, respectively, said first transmitter being arranged for transmitting to said first receiver a release command and also the energy needed for operation of said second transmitter and said release mechanism, both of which are arranged in one of said jaws.

2. The safety ski binding according to claim 1, wherein said signal-processing circuit, said first transmitter and said second receiver are arranged in the ski.

3. The safety ski binding according to claim 1 or claim 2, wherein said first and second transmitter-receiver arrangements each have two capacitively coupled and electrically isolated conductive plates, one said plate being provided in the ski and the other said plate being provided in said one jaw.

4. The safety ski binding according to claim 1 or claim 2, wherein said first and second transmitter-receiver arrangements each have two inductively coupled coils.

* * * * *